US010858896B2

(12) United States Patent
Jones

(10) Patent No.: US 10,858,896 B2
(45) Date of Patent: Dec. 8, 2020

(54) TELESCOPIC DRILL ROD

(71) Applicants: Hayward Baker, Inc., Hanover, MD (US); Jim Jones, Canton, GA (US)

(72) Inventor: Jim Jones, Canton, GA (US)

( * ) Notice: Subject to any disclaimer, the term of this patent is extended or adjusted under 35 U.S.C. 154(b) by 60 days.

(21) Appl. No.: 16/091,382

(22) PCT Filed: Apr. 5, 2017

(86) PCT No.: PCT/US2017/026184
§ 371 (c)(1),
(2) Date: Oct. 4, 2018

(87) PCT Pub. No.: WO2017/176907
PCT Pub. Date: Oct. 12, 2017

(65) Prior Publication Data

US 2019/0136641 A1 May 9, 2019

Related U.S. Application Data

(60) Provisional application No. 62/318,252, filed on Apr. 5, 2016.

(51) Int. Cl.

| | |
|---|---|
| ***E21B 17/07*** | (2006.01) |
| ***E21B 19/084*** | (2006.01) |
| ***E21B 7/20*** | (2006.01) |
| ***E21B 19/00*** | (2006.01) |
| ***E21B 7/00*** | (2006.01) |
| ***E21B 17/02*** | (2006.01) |
| ***E21B 17/042*** | (2006.01) |
| ***E21B 17/043*** | (2006.01) |

(52) U.S. Cl.
CPC ..... *E21B 17/07* (2013.01); *E21B 7/00* (2013.01); *E21B 7/20* (2013.01); *E21B 17/02* (2013.01); *E21B 17/043* (2013.01); *E21B 17/0426* (2013.01); *E21B 19/00* (2013.01); *E21B 19/084* (2013.01)

(58) Field of Classification Search
CPC ... E21B 17/07; E21B 7/00; E21B 7/20; E21B 17/02; E21B 17/0426; E21B 17/043; E21B 19/00; E21B 19/084
See application file for complete search history.

(56) References Cited

U.S. PATENT DOCUMENTS

| | | | | |
|---|---|---|---|---|
| 1,635,289 A * | 7/1927 | Scott | ..... | E21B 17/07 285/302 |
| 3,255,612 A | 6/1966 | Mayer et al. | | |
| 3,447,652 A | 6/1969 | Tipton | | |
| 3,517,760 A | 6/1970 | Kehrberger | | |

(Continued)

*Primary Examiner* — Nicole Coy
(74) *Attorney, Agent, or Firm* — Royal W. Craig; Gordan Feinblatt LLC

(57) ABSTRACT

A telescopic drill rod (2) has at least two rod members (20, 30} disposed coaxially to one another, with the inner rod member (30) being axially slidable relative to the cater rod member (20) in a telescoping mariner between an extended position and a retracted position. Both the inner rod member (30) and outer rod member (20) are equipped with joints at each end for connection, to a drill head and/or another section of drill pipe. The joints also lock the inner and outer rod members in either the extended of retracted positions, and this is accomplished with a unique frusto-conical threaded engagement that is well-suited for transmitting pressure forces.

20 Claims, 2 Drawing Sheets

(56) References Cited

U.S. PATENT DOCUMENTS

| | | | | |
|---|---|---|---|---|
| 3,842,619 | A | 10/1974 | Bychurch, Sr. | |
| 5,168,944 | A | 12/1992 | Andersson | |
| 5,368,083 | A * | 11/1994 | Beck, III | E21B 3/04 175/195 |
| 6,293,172 | B1 | 9/2001 | Smith | |

* cited by examiner

TELESCOPIC DRILL ROD

CROSS-REFERENCE TO RELATED APPLICATION(S)

The present application derives priority from U.S. provisional patent application Ser. No. 62/318,252 filed 5 Apr. 2016.

BACKGROUND OF THE INVENTION

1. Field of the Invention

The present invention relates to drill rods for ground (soil and rock) drilling equipment, and more particularly, to drill rods comprising a number of members extendable m the manner of a telescope. The rods can be used with non-telescoping rods or with additional telescoping rods to allow ground drilling connecting a drilling rig to a drilling bit to allow for drill hole advancement.

2. Description of the Background

Mobile drill rigs are typically used for earth drilling in various geologic drilling applications. The mobile drill rig typically includes a drill mast mounted onto a truck chassis. A rotatable drill head is slideably mounted on the drill mast and can be driven up or down along the length of the erected drill mast. The drill head screws a drill string into the ground, gripping and turning the uppermost section of drill pipe of the string.

Drill pipe, is hollow, thin-walled, steel piping and comes in a variety of sizes, strengths, and weights but are typically within a range of from 5 to 40 feet in length. They are hollow to allow drilling fluid to be pumped through them, down the hole, and back up.

In practice, the drill string is extended by drilling in each drill rod sequentially and by attaching the next rod to the trailing end of the drill string, and repeating. This change-over is difficult, time consuming and sometimes dangerous.

It would be highly desirable to provide a drill rod that can be used for drilling a bore and also limit the number of assembly iterations required to advance the drill hole The present invention does this with a telescopic ally extendable drill rod that may be extended during the actual drilling operation thereby avoiding any need to assemble further sections to the drill rod in order to extend it. The present invention also allows the use of a shorter drill mast, which in turn requires fewer tooling additions and smaller and more economical equipment. Also, the shorter drill masts facilitates drilling in limited access conditions that would preclude the use of large equipment with longer drill masts.

One skilled in the art will understand that Kelly drilling employs "telescopically extendable" drill attachments in a loose sense. Kelly drilling is often used for oil drilling and for the production of foundation piles for buildings. In this case, the rotary drive of the drill turns a Kelly rod arrangement, which comprises several nested tubular Kelly rods of square cross-section. The rotational movement of one rod is transmitted to the adjacent Kelly rod. Kelly rod attachments can be added down the hole. Kelly drilling is good for larger holes and rocky formations but is not well-suited for "tie-back" (micropile) drill rigs and other small hole drilling rigs. A tieback is a horizontal wire, rod, or helical anchor used to reinforce retaining walls for stability. With one end of the tieback secured to the wall, the other end is anchored to as micropile anchored in the earth. The tieback-pile structure resists forces that would otherwise cause the wall to lean. What is needed is a telescopically extendable drill rod more suitable for use with tieback drill rigs (alternately known as micropile drill rigs) suitable for use in a wide range of small-hole drilling applications including anchor drilling, micropiles, soil nailing, water wells and jet grouting, and other such smaller hole drilling.

SUMMARY OF THE INVENTION

An object of the invention is to provide a telescopic drill rod which is of the simplest possible construction but which is nevertheless able to transmit drilling pressure when in the extended position. A further object of the invention is to enable the individual members of the rod, while in the extended position, to be easily connected together and also easily disconnected using standard rotary tieback drilling equipment for installations substantially similar to those as described above.

The invention comprises a telescopic drill rod comprising at least two rod members disposed coaxially to one another, including an inner rod member and an outer rod member axially slidable relative to each other in a telescoping manner between an extended position and a retracted position. Both the inner rod member and outer rod member are equipped with joints at each end for connection to a drill head and/or another section of drill pipe. The joints also lock the inner and outer rod members in either the extended or retracted positions, and this is accomplished with a unique frusto-conical threaded engagement that is well-suited for transmitting pressure forces.

The invention makes n possible for the members of a telescopic drill rod to be coupled together in the extended position, without further aids or additional devices, in a simple, convenient manner which is particularly suitable for practical operation, in such a manner that rotational and axial drilling forces with or without drilling fluid use can be applied.

For a more complete understanding of the invention, its objects and advantages, refer to the remaining specification and to the accompanying drawings.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

The present invention is a telescopic drill rod comprising two or more rod members: at least including an inner rod member and an outer rod member axially slidable relative to each other in a telescoping configuration between an extended position and a retracted position.

Figure 1:
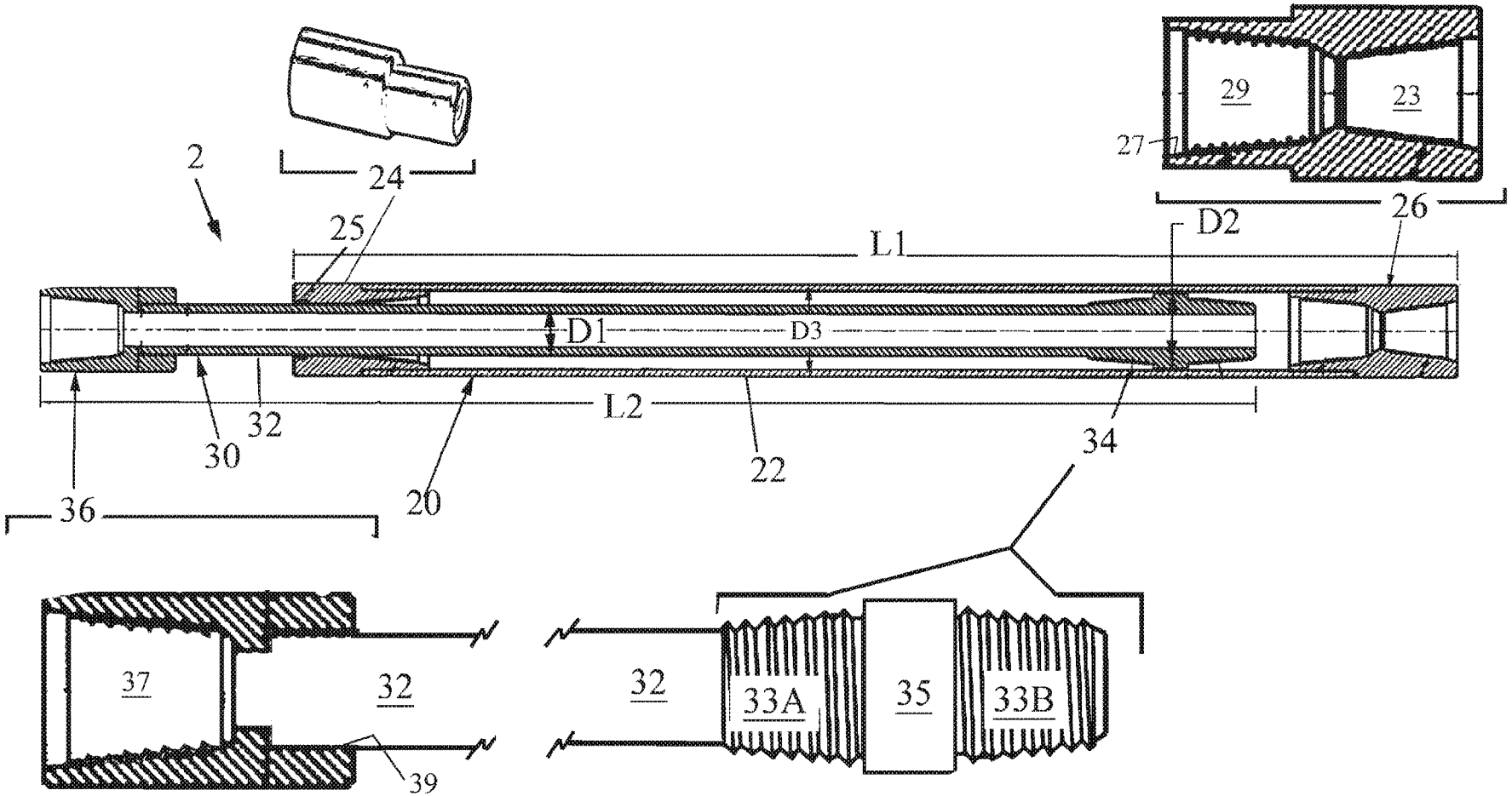
FIG. 1 is a side cross-Section of a telescopic drill rod 2 in its unsecured intermediate position according in an embodiment of the invention with enlarged insets of some components.

FIG. 1 is a side cross-section of a telescopic drill rod 2 according to an embodiment of the invention shown in an intermediate (unsecured) position. The telescopic drill rod generally comprises the inner rod member 30 and outer rod member 20, inner rod member 30 being slidably carried in telescoping manner within the outer rod member 20. The inner rod member 30 can be secured in a fully retracted position (shown and described below with reference to FIG. 2), unsecured as shown in FIG. 1 for free telescoping extension or retraction, or fully extended and secured in the fully extended position (shown and described below with reference to FIG. 3).

The inner rod member 30 further comprises an elongate hollow pipe section 32 of uniform or variable cross-section D1 extending from one end to an enlarged double-male joint 34 at the other end. Section 32 preferably has a uniform cross-section along its length symmetric about a central axis, and subject to that constraint may be cylindrical, hexagonal, octagonal or otherwise. As seen in the enlarged center inset to FIG. 1 double-male joint 34 comprises a bulbous distal tip shaped with two threaded surfaces 33A, 33B separated by a raised medial collar 35 of diameter D2. In the preferred embodiment both threaded surfaces 33A, 33B are oppositely tapered as shown, in which case the two threaded surfaces 33A, 33B comprise frusto-conical shapes tapering away from collar 35 with surfaces screw-threaded along their lengths. The frusto-conical shape provides a wedging effect. However, one skilled in the art will understand that non-tapered threads are suitable, in which case the case the two threaded surfaces 33A, 33B are of uniform cross-section comprising cylindrical shapes with surfaces screw-threaded along their lengths. In either case the collar 33 is of slightly greater diameter D2 than the largest threads of surfaces 33A, 33B and presents a smooth flat surface to serve as a bushing for slidable engagement with the inner surface of outer rod member 20. The smallest threads of surfaces 33A, 33B are of slightly greater width/diameter D1 than the hollow pipe section 32.

The inner rod member 30 extends to another single-female joint 36 mounted on the other end. Single female joint 36 comprises a thicker cylindrical section of uniform exterior dimension formed with a cylindrical receptacle 39 on one end of diameter slightly larger than D2 for a compression and/or screw-threaded fit with cylindrical section 32. The outer face of single-female joint 36 is formed with a screw-threaded receptacle (again, tapered-conical or non-tapered threads) opening outward to an aperture. The receptacle of single-female joint 36 is shaped, dimensioned and threaded for screw-insertion of a conventional drill head (not shown) or, alternatively, for screw-insertion of another inner rod member 30.

The outer rod member 20 comprises an elongate hollow cylinder 22 of inner diameter D3 slightly greater than D2 of collar 33 for slidable insertion of the double-male joint 34 of inner rod member 30. The leftmost end of the outer rod member 20 is equipped with a single-female joint 24 compression and/or screw-threaded into the end of cylinder 22. Single-female joint 24 is a thicker cylindrical section having a two-tier exterior dimension for flush insertion into the cylinder 22. The inner face of single-female joint 24 is formed with a threaded receptacle (again, tapered-conical or non-tapered threads) opening inward from an aperture to a through-bore of diameter D1. Where tapered threads are used, the receptacle of the inner face of single-female joint 24 is frusto-conical, and the frusto-conical receptacle of single-female joint 24 is shaped, dimensioned and threaded to conform to the innermost frusto-conical threaded surface 33A of the double-male joint 34 of inner rod member 30 for screw-insertion therein. However, one skilled in the art will understand that non-tapered threads are suitable, in which case the case the threaded surface of the receptacle of the inner face of single-female joint 24 is of substantially uniform cross-section with non-tapered threads. The through-bore through single-female joint 24 continues outward through the outer face of single-female joint 24, and the through-bore may or may not be internally grooved for holding a rubberized rod wiper 25, e.g., an O-ring or other such wiping device or mechanism captive therein where wiping might be of advantage to the drilling. The rod wiper 2 squeegees the inner rod member 30 clean as is slides through.

The other end (rightward) of the outer rod member 20 is equipped with a double-female joint 26 that is compression and/or screw-threaded into the end of cylinder 22. Double-female joint 26 is a thicker cylindrical section having a two-tier exterior dimension for flush insertion into the cylinder 22. The inner (leftmost) face of double-female joint 26 is formed with an inner cylindrical lip 27 having a diameter slightly more than D2, lip 27 opening inward to a threaded receptacle 29 shaped, dimensioned and threaded to conform to the outermost threaded surface 33B of the double-male joint 34 of inner rod member 30 for screw-insertion therein. Once more, tapered-conical or non-tapered threads may be used. Where tapered threads are used as shown, the receptacle 29 of double-female joint 26 is frusto-conical, and the frusto-conical receptacle 29 of double-female joint 26 is shaped, dimensioned and threaded to conform to the outermost frusto-conical threaded surface 33B of the double-male joint 34 of inner rod member 30 for screw-insertion therein. However, one skilled in the art will understand that non-tapered threads are suitable, in which case the case the threaded surface of the receptacle of the receptacle of double-female joint 26 is of uniform cross-section. The outer (rightmost) face of double-female joint 26 is likewise formed with a non-tapered (uniform) or tapered (frusta-conical) threaded receptacle 23. A tapered threaded receptacle 23 is illustrated in FIG. 1 with a diameter tapering outward to an aperture of slightly more than D2.

The length of outer rod member 20 is L1, and inner rod member 30 is L2, giving a sum component length of L1+L2. However, it should now be apparent that the invention makes it possible for the inner and outer members 30, 20 of the telescopic drill rod 2 may be securely coupled together in the retracted and/or extended position by screw-insertion, without aid from further devices, in a simple, convenient manner. The present configuration optimizes both extension and retraction without compromising strength and security when locked in either the fully extended or fully retracted position.

Figure 2:
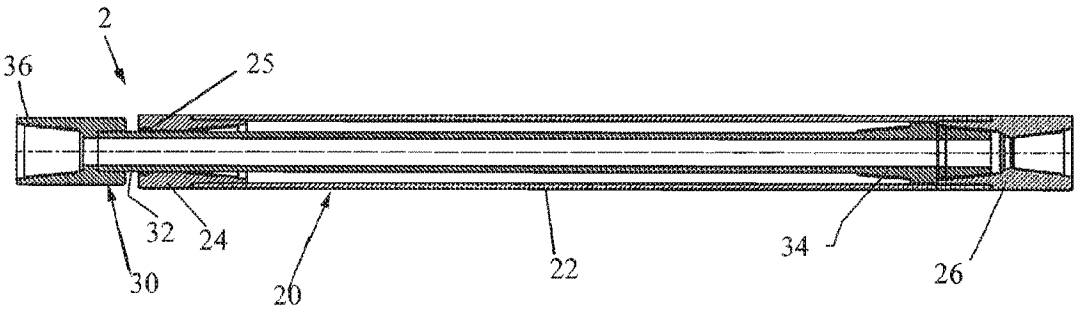
FIG. 2 shows the telescopic drill rod 2 secured in its fully-retracted position.

FIG. 2 shows the telescopic drill rod 2 in its fully-retracted position with the double-male joint 34 of inner rod member 30 screw-inserted into the leftmost receptacle of the double female joint 26 of outer rod member 20. In this position the total length L3 is greater than L1 by about the length of single-male receptacle 36.

Figure 3:
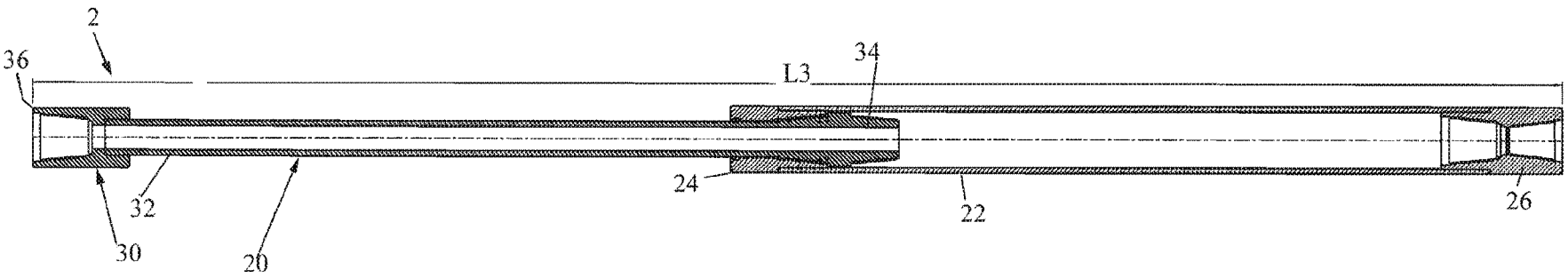
FIG. 3 shows the telescopic drill rod 2 secured in its fully-extended position.

FIG. 3 shows the telescopic drill rod 2 in its fully-extended position with the double-male joint 34 of inner rod member 30 screw-inserted into the female receptacle of the single female joint 24 of outer rod member 20. In this position L3 is slightly less than L1+L2 by a bit more than the length of double-male joint 34.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

STATEMENT OF INDUSTRIAL APPLICABILITY

Large hole drilling application's sometimes use "Kelly drills" that employ telescopically extendable drill attachments, allowing Kelly rod attachments to be added down the hole. However, there are numerous construction applications that require small-hole drilling including anchor drilling, micropiles, soil nailing, water wells and jet grouting, and other such smaller hole drilling. While conventional Kelly drilling is good for larger holes and rocky formations it is not well-suited for "tieback" (micropile) drill rigs and other small hole drilling rigs. There would be great industrial applicability in a telescopically extendable drill rod more suitable for use with tieback drill rigs (alternately known as micropile drill rigs) suitable for use in small-hole drilling.

I claim:

1. A telescopic drill rod, comprising two or more rod members at least including:

an inner rod member including, a first hollow tubular section of uniform cross-section along its length, a first connector attached distally at one end of said first hollow tubular section, said first connector comprising a double-male joint formed with two externally-screw-threaded surfaces separated from each other by a medial collar, and a second connector attached distally at another end of said first hollow tubular section, said second connector comprising a single-female joint formed with a receptacle open outward and away from said first hollow tubular section and having an internally-screw-threaded surface; and an outer rod member including, a second hollow tubular section having a uniform internal channel conforming to said medial collar and configured for slidable reciprocation therein, a third connector attached distally at one end of said second hollow tubular section, said third connector comprising a double-female joint formed with opposing receptacles each having an internally-screw-threaded surface, and a fourth connector attached distally at another end of said second hollow tubular section, said fourth connector comprising a single-female joint formed with a receptacle having an internally-screw-threaded surface, whereby said inner rod member and said outer rod member may be telescopically extended and secured together in a fully-extended position and retracted and secured together in a fully-retracted position, and in said fully-retracted position present constant exterior shape and dimensions along an entire length of said outer telescopic drill rod.

2. The telescopic drill rod according to claim 1, wherein said inner rod member further comprises a hollow cylindrical section of uniform diameter and a central passage passing entirely through said inner rod including said first connector and said second connector.

3. The telescopic drill rod according to claim 2, wherein said outer rod member further comprises a hollow cylindrical section of uniform diameter.

4. The telescopic drill rod according to claim 3, wherein in said fully-retracted position said inner rod member and outer rod member together present a constant exterior profile along an entire length of said telescopic drill rod.

5. The telescopic drill rod according to claim 1, wherein the two externally-screw-threaded surfaces of the first connector double-male joint are tapered.

6. The telescopic drill rod according to claim 1, wherein the two externally-screw-threaded surfaces of the first connector double-male joint are non-tapered.

7. The telescopic drill rod according to claim 1, wherein the internally-threaded receptacle of the second connector single-female joint of the inner rod member is tapered.

8. The telescopic drill rod according to claim 1, wherein the internally-threaded receptacle of the second connector single-female joint of the inner rod member is non-tapered.

9. The telescopic drill rod according to claim 1, wherein the internally-threaded receptacles of the third connector double-female joint of the outer rod member are tapered.

10. The telescopic drill rod according to claim 1, wherein the internally-threaded receptacles of the third connector double-female joint of the outer rod member are non-tapered.

11. The telescopic drill rod according to claim 1, wherein the internally-threaded receptacle of the fourth connector single-female joint of the outer rod member is tapered.

12. The telescopic drill rod according to claim 1, wherein the internally-threaded receptacle of the fourth connector single-female joint of the outer rod member is non-tapered.

13. A telescopic drill rod, comprising two or more rod members at least including:

an inner rod member and an outer rod member axially slidable relative to each other in a telescoping configuration, said inner rod member further comprising an elongate hollow cylindrical section of uniform diameter along a majority of its length and extending to a double-male joint formed as a bulbous distal tip and shaped with two frusto-conical surfaces separated by a medial collar, and a single-female joint having a female frusto-conical receptacle mounted on another end of said cylindrical section, said outer rod member further comprising a hollow cylinder having a single-female joint formed with a frusto-conical receptacle at one end of said hollow cylinder, and double-female joint formed with opposing frusto-conical receptacles at another end of said hollow cylinder, whereby said inner and outer members may be coupled together in a retracted and/or extended position, and in said fully-retracted position together present a constant exterior profile along an entire length of said telescopic drill rod.

14. The telescopic drill rod according to claim 13, further comprising a central passage passing entirely through said inner rod including said first connector and said second connector, and said outer rod including said third connector and fourth connector.

15. The telescopic drill rod according to claim 14, wherein said inner rod further comprises a hollow cylindrical section of uniform diameter and the single female joint of said second connector comprises a receptacle open outward and away from said first hollow cylindrical section.

16. The telescopic drill rod according to claim 15, wherein said outer rod member further comprises a hollow cylindrical section of uniform diameter.

17. The telescopic drill rod according to claim 16, wherein in said fully-retracted position said inner rod and said outer rod combine to present a constant exterior profile along an entire length of said telescopic drill rod.

18. The telescopic drill rod according to claim 14, wherein all of said male and female locking joints include screw-threaded surfaces.

19. The telescopic drill rod according to claim 18, wherein all of said screw-threaded surfaces are tapered.

20. The telescopic drill rod according to claim 18, wherein all of said screw-threaded surfaces are non-tapered.

* * * * *